US011629489B2

(12) United States Patent
Ebisu

(10) Patent No.: US 11,629,489 B2
(45) Date of Patent: Apr. 18, 2023

(54) BOX-SHAPED BUILDING UNIT AND BUILDING

(71) Applicant: SAI GROUP HOLDINGS KABUSHIKI KAISHA, Fukuoka (JP)

(72) Inventor: Kenya Ebisu, Fukuoka (JP)

(73) Assignee: SAI GROUP HOLDINGS KABUSHIKI KAISHA, Fukuoka (JP)

( * ) Notice: Subject to any disclaimer, the term of this patent is extended or adjusted under 35 U.S.C. 154(b) by 0 days.

(21) Appl. No.: 17/265,042

(22) PCT Filed: Jul. 23, 2019

(86) PCT No.: PCT/JP2019/028781
§ 371 (c)(1),
(2) Date: Feb. 1, 2021

(87) PCT Pub. No.: WO2020/026886
PCT Pub. Date: Feb. 6, 2020

(65) Prior Publication Data

US 2021/0310232 A1 Oct. 7, 2021

(30) Foreign Application Priority Data

Aug. 1, 2018 (JP) ..... JP2018-145281

(51) Int. Cl.
*E04B 1/10* (2006.01)
*E04B 1/348* (2006.01)
*E04B 1/61* (2006.01)

(52) U.S. Cl.
CPC ..... *E04B 1/10* (2013.01); *E04B 1/348* (2013.01); *E04B 1/612* (2013.01); *E04B 2001/6195* (2013.01)

(58) Field of Classification Search
CPC ..... E04B 2001/2632; E04B 2001/2636; E04B 2001/2664; E04B 2001/6195;
(Continued)

(56) References Cited

U.S. PATENT DOCUMENTS 733,500 A * 7/1903 Moore ..... F16B 5/02 403/376
2,647,287 A * 8/1953 Jones ..... E04B 1/6183 52/582.2

(Continued)

FOREIGN PATENT DOCUMENTS

AU 2002245944 B2 11/2006
JP 2004-523399 A 8/2004

(Continued)

OTHER PUBLICATIONS

First Office Action Issued in related Japanese Application No. 2018-145281 dated May 21, 2019 and its English translation.

(Continued)

*Primary Examiner* — Jessica L Laux
(74) *Attorney, Agent, or Firm* — Renner, Otto, Boisselle & Sklar, LLP

(57) ABSTRACT

Readily joining CLT panels to obtain a box-shaped building unit.

An orthogonal part of each surface of a rectangular parallelepiped has a structure wherein a surface of edge of lumber 11*s* of a CLT panel 11 is made abut on an inner main surface 10*i* of a CLT panel 10 and joined thereto by a joining member 2 so that a surface of edge of lumber 10*s* of the CLT panel 10 and an outer main surface 11*o* of the CLT panel 11 are flush. A joining part by the joining member 2 has a structure wherein the surface of edge of lumber 10*s* and the inner main surface 10*i* and outer main surface 10*o* of the CLT panel 10 are opened so that the outer main surface 10*o* side is wider than the inner main surface 10*i* side, the surface of edge of lumber 11*s* and at least the outer main surface 11*o* of the CLT panel 11 are opened so that the inner side of the CLT panel 11 is wider than the surface of edge of lumber 11*s* side, and the butterfly joint-shaped joining member 2 is inserted into the opening of the CLT panel 10 and the (Continued)

opening of the CLT panel 11 from the surface of edge of lumber 10*s* of the CLT panel 10 and the outer main surface 11*o* of the CLT panel 11 side.

4 Claims, 7 Drawing Sheets

(58) Field of Classification Search
CPC .... E04B 1/6141; E04B 1/6145; E04B 1/6162; E04B 1/6104; E04B 1/6108; E04B 1/6118; E04B 1/612; E04B 1/348; E04B 1/34815; E04B 1/34838; E04B 1/34861; E04B 1/10
See application file for complete search history.

(56) References Cited

U.S. PATENT DOCUMENTS

| | | | | |
|---|---|---|---|---|
| 5,357,728 | A | 10/1994 | Duncanson | |
| 2001/0032434 | A1* | 10/2001 | Hoffmann | E04B 1/2604 52/702 |
| 2009/0241460 | A1* | 10/2009 | Beaulieu | E04B 1/6129 52/586.2 |
| 2017/0350432 | A1* | 12/2017 | Hudson | E04C 2/205 |

FOREIGN PATENT DOCUMENTS

| | | | |
|---|---|---|---|
| JP | 2008101354 | A | 5/2008 |
| JP | 2018-9327 | A | 1/2018 |
| JP | 2018-9360 | A | 1/2018 |
| JP | 6271061 | | 1/2018 |
| WO | 02/083379 | A1 | 10/2002 |
| WO | 2014098599 | A1 | 6/2014 |

OTHER PUBLICATIONS

First Office Action issued in related Japanese Application No. 2019-125148 dated Jul. 17, 2020 and its English translation.
Satoshi Yoshino Architectural Design Office Blog, Kofu City, Yamanashi Prefecture, Japan, Jan. 9, 2012, search date: May 15, 2019, URL,http://sekkei / y.com/mt/2012/01/post_980.html and machine translation.
International Search Report for related International Application No. PCT/JP2019/028781 dated Oct. 8, 2019 and its English translation.
First Office Action issued in related Chinese Application No. 201980051229.9 dated Sep. 13, 2021 and its English Machine Translation.
Decision of Rejection for corresponding Chinese Application No. 201980051229.9 dated Feb. 22, 2022 an its English Translation.
First Office Action for corresponding Taiwanese Application No. 108127078 dated Nov. 21, 2022 and its English Translation.

* cited by examiner

BOX-SHAPED BUILDING UNIT AND BUILDING

TECHNICAL FIELD

The present invention relates to a box-shaped building unit formed of panels (CLT panels) consisting of cross-laminated-timbers (CLTs) and a building using said unit.

BACKGROUND ART

A cross-laminated-timber (CLT) is a panel formed by laminating and adhering layers so that the fiber directions of the plate are orthogonal to each other in each layer. Since a CLT panel is made of orthogonally laminated layers, it has characteristics of more stable strength than laminated lumber that has been used as building materials, difficulty in deformation, strength comparable to concrete, and excellent thermal insulation as well.

A housing structure utilizing said CLT panels has been conventionally proposed. For example, Patent Literature 1 describes arranging a box-shaped panel of two or more CLT panels or the like so that the box-shaped panel is supported by its own weight, thereby constructing a building without using a particular coupling tool. Furthermore, Patent Literature 1 also describes that a coupling tool such as a hinge may be utilized and a convex part or a recessed part may be provided to a joining surface.

Further, for example, Patent Literature 2 describes a joining structure of CLT panels wherein two or more CLT panels are joined with rod-like tightening members with a large diameter and a small diameter that extend to cross each other and are buried in the CLT panels and an adhesive.

CITATION LIST

Patent Literature

[PTL 1] Japanese Patent No. 6271061
[PTL 2] Japanese Laid-Open Publication No. 2018-9327

SUMMARY OF INVENTION

Technical Problem

The building described in Patent Literature 1 is a building that can be constructed without using a particular coupling tool. The literature describes that a coupling tool such as a hinge may be utilized and a convex part or a recessed part may be provided to a joining surface. However, basically, the arrangement of CLT panels is devised so that they are supported by their own weight, which is merely auxiliary positioning and is not expected to achieve the joining strength.

Further, the joining structure described in Patent Literature 2 is a structure wherein burying holes are formed on the CLT panels and the rod-like tightening members with a large diameter and a small diameter are inserted into these burying holes. However, since the CLT panels are quite heavy, they need to be assembled using a crane. Thus, it is very difficult to insert a tightening member inserted into a burying hole of one CLT panel into a burying hole of the other CLT panel.

Therefore, the objective of the present invention is to readily join CLT panels to obtain a box-shaped building unit, and provide a building using the same.

Solution to Problem

The box-shaped building unit of the present invention is a box-shaped building unit formed by arranging a CLT panel on each surface of a rectangular parallelepiped and joining adjacent CLT panels, an orthogonal part of each surface of the rectangular parallelepiped having a structure wherein a surface of end of lumber or a surface of edge of lumber of a second CLT panel is made abut on an inner main surface of a first CLT panel and joined thereto by a joining member so that a surface of end of lumber or a surface of edge of lumber of the first CLT panel and an outer main surface of the second CLT panel are flush, and a joining part by the joining member having a structure wherein the surface of end of lumber or the surface of edge of lumber and the inner main surface and an outer main surface of the first CLT panel are opened so that the outer main surface side is wider than the inner main surface side of the first CLT panel, wherein the surface of end of lumber or the surface of edge of lumber and at least the outer main surface of the second CLT panel are opened so that the inner side of the second CLT panel is wider than the surface of end of lumber or surface of edge of lumber side of the second CLT panel, and wherein a butterfly joint-shaped joining member is inserted into an opening of the first CLT panel and an opening of the second CLT panel from the surface of end of lumber or the surface of edge of lumber of the first CLT panel and the outer main surface of the second CLT panel side.

According to the box-shaped building unit of the present invention, when a CLT panel is arranged on each surface of the rectangular parallelepiped and adjacent CLT panels are joined, once the butterfly joint-shaped joining member is inserted into the opening of the first CLT panel and the opening of the second CLT panel that are outwardly opened from the surface of end of lumber or surface of edge of lumber of the first CLT panel and the outer main surface of the second CLT panel side, the first CLT panel and the second CLT panel are tightened and joined by this butterfly joint-shaped joining member.

In this regard, the butterfly joint-shaped joining member preferably consists of a first member having a shape corresponding to the opening of the first CLT panel and a second member having a shape corresponding to the opening of the second CLT panel that are coupled by a bolt/nut that can be tightened from the outer main surface side of the first CLT panel. This makes it possible to tighten the bolt/nut from the outer main surface side of the first CLT panel to tighten the butterfly joint-shaped joining member when the first CLT panel and the second CLT panel are loosely tightened, thereby firmly tightening the first CLT panel and the second CLT panel.

Advantageous Effects of Invention (1) An orthogonal part of each surface of a rectangular parallelepiped has a structure wherein a surface of end of lumber or a surface of edge of lumber of a second CLT panel is made abut on an inner main surface of a first CLT panel and joined thereto by a joining member so that a surface of end of lumber or a surface of edge of lumber of the first CLT panel and an outer main surface of the second CLT panel are flush. A joining part by the joining member has a structure wherein the surface of end of lumber or surface of edge of lumber and the inner main surface and an outer main surface of the first CLT panel are opened so that the outer main surface side is wider than the inner main surface side of the first CLT panel, wherein the surface of end of lumber or the surface of edge of lumber and at least the outer main surface of the second CLT panel are opened so that the inner side of the second CLT panel is wider than the surface of end of lumber or surface of edge of lumber side of the second CLT panel, and wherein a butterfly joint-shaped joining member is inserted into an opening of the first CLT panel and an opening of the second CLT panel from the surface of end of lumber or surface of edge of lumber of the first CLT panel and the outer main surface of the second CLT panel side. As a result of these structures, it is possible to readily join the CLT panels and obtain a box-shaped building unit by arranging a CLT panel on each surface of the rectangular parallelepiped and inserting the butterfly joint-shaped joining member into the opening of the first CLT panel and the opening of the second CLT panel that are outwardly opened. Further, it is possible to obtain a building by coupling a plurality of these box-shaped building units.

(2) The butterfly joint-shaped joining member is configured to consist of a first member having a shape corresponding to the opening of the first CLT panel and a second member having a shape corresponding to the opening of the second CLT panel that are coupled by a bolt/nut that can be tightened from the outer main surface side of the first CLT panel. As a result of this configuration, it is possible to tighten the bolt/nut from the outer main surface side of the first CLT panel to tighten the butterfly joint-shaped joining member when the first CLT panel and the second CLT panel are loosely tightened, thereby firmly tightening the first CLT panel and the second CLT panel.

DESCRIPTION OF EMBODIMENTS

Figure 1:
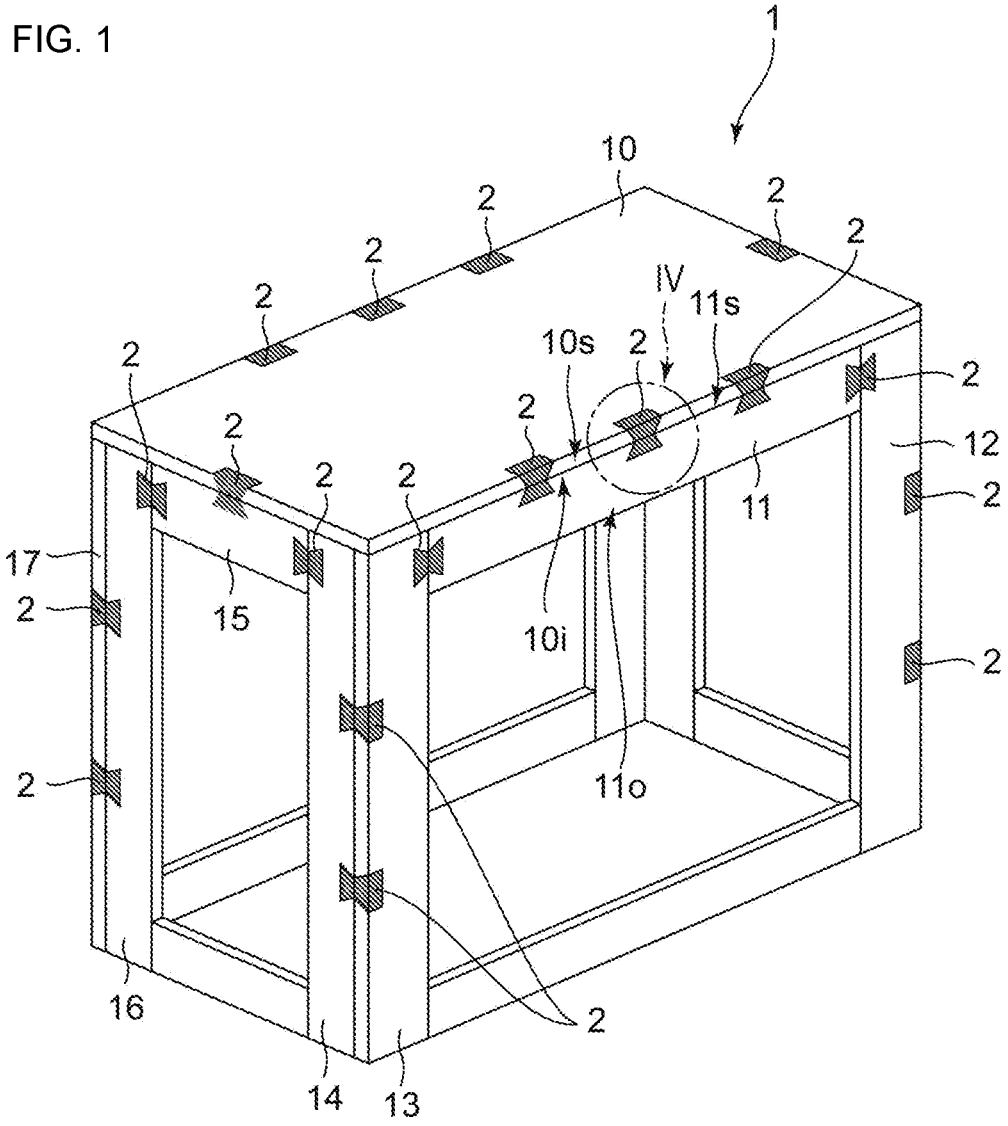
FIG. 1 is a perspective view of a box-shaped building unit in an embodiment of the present invention.
Figure 2:
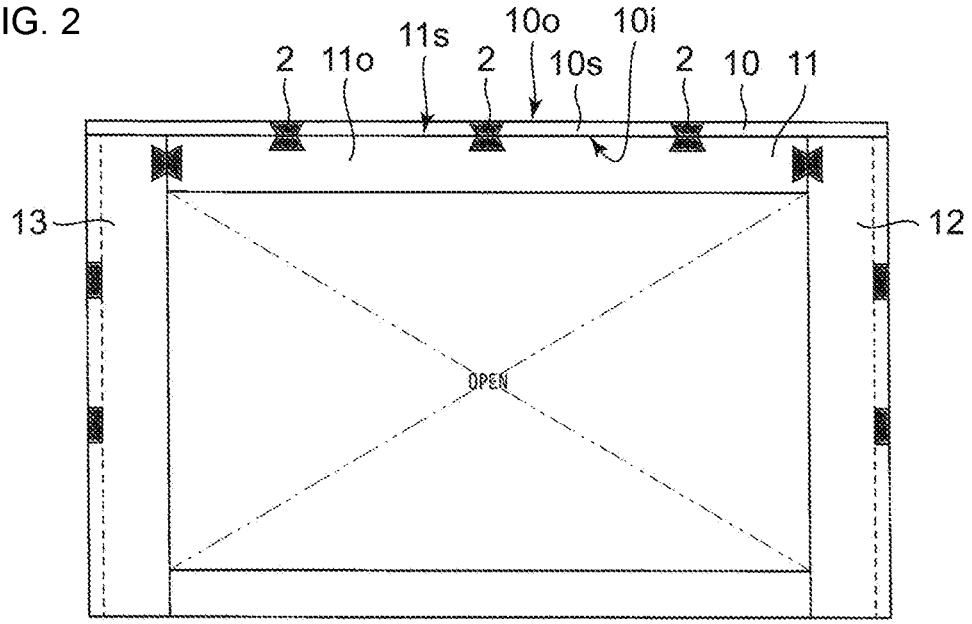
FIG. 2 is a front view of the box-shaped building unit of FIG. 1.
Figure 3:
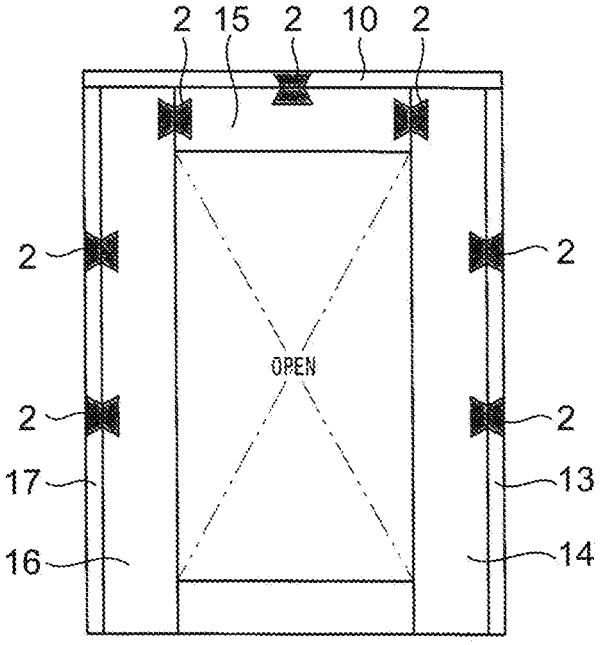
FIG. 3 is a left side view of FIG. 2.
Figure 4:
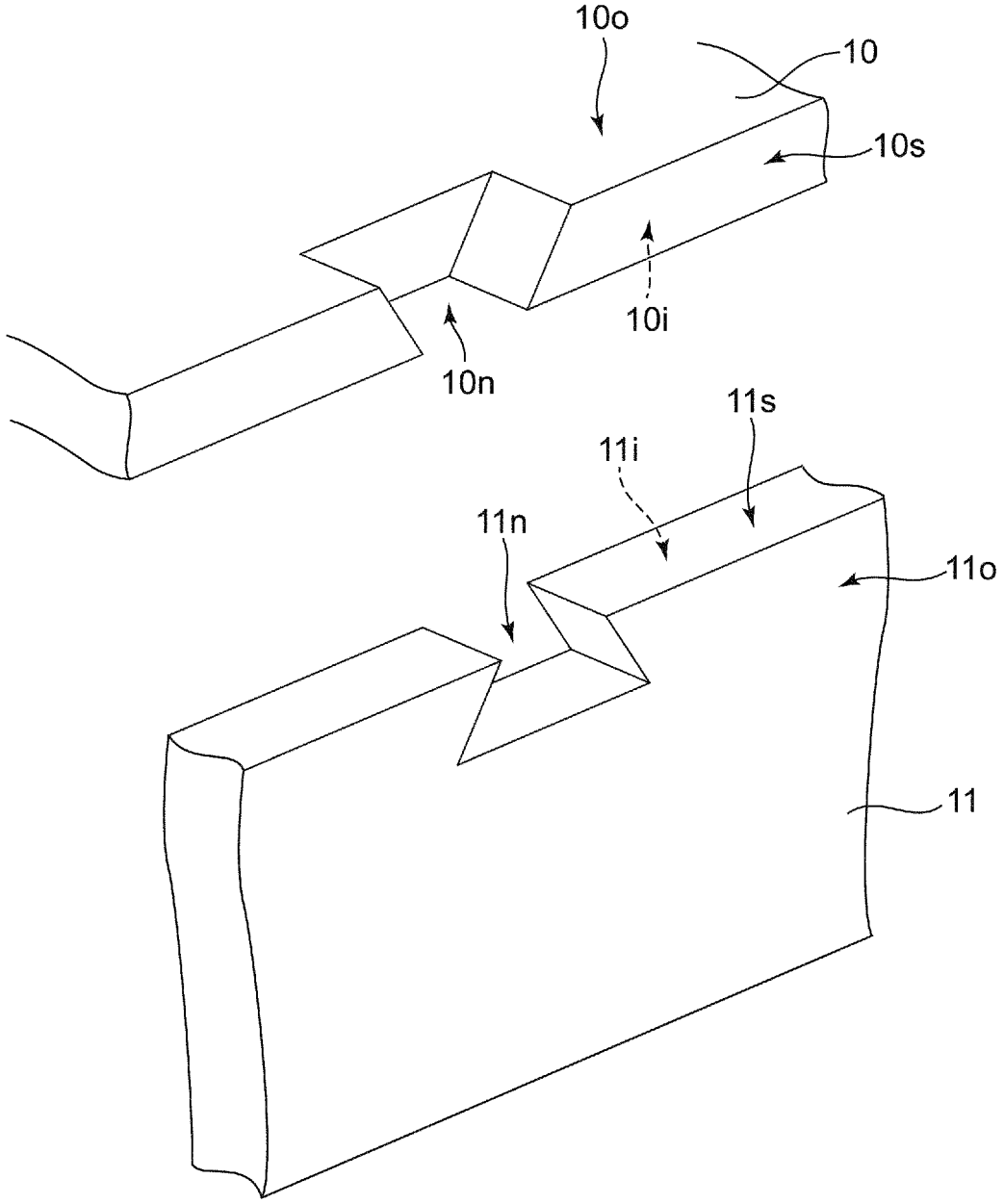
FIG. 4 is an exploded perspective view of the joining part of a CLT panel, which enlarges the IV part of FIG. 1.
Figure 5:
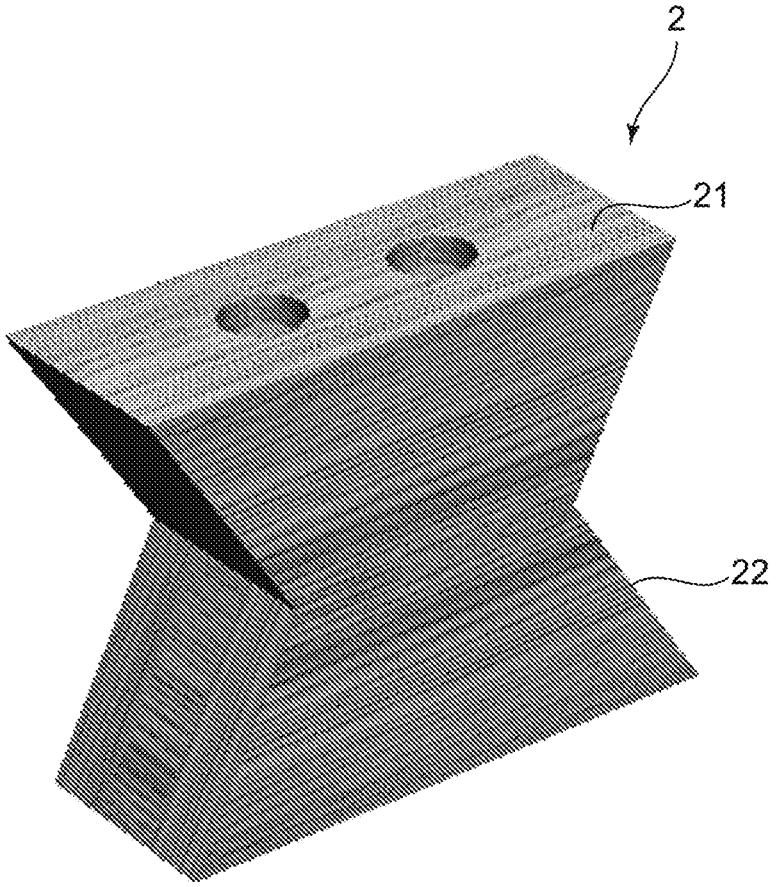
FIG. 5 is a perspective view of a joining member.
Figure 6:
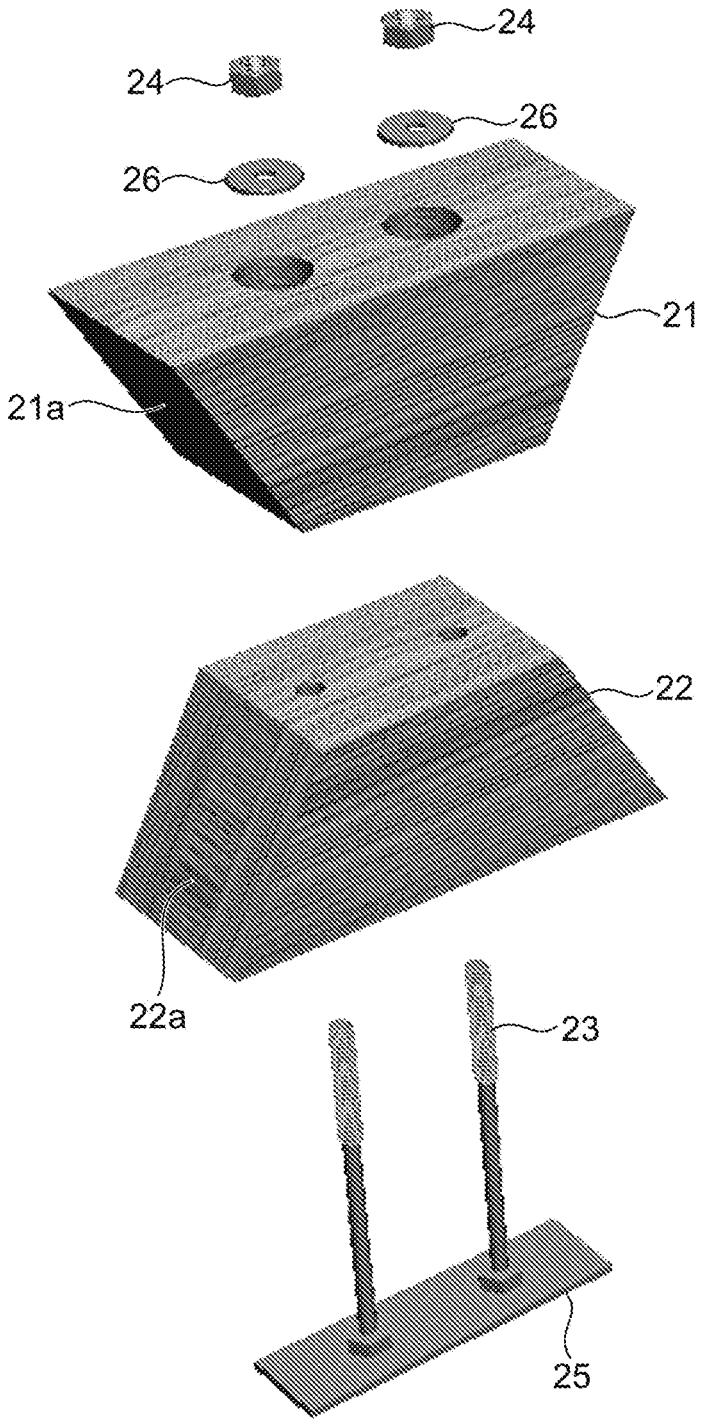
FIG. 6 is an exploded perspective view of the joining member of FIG. 5.
Figure 7:
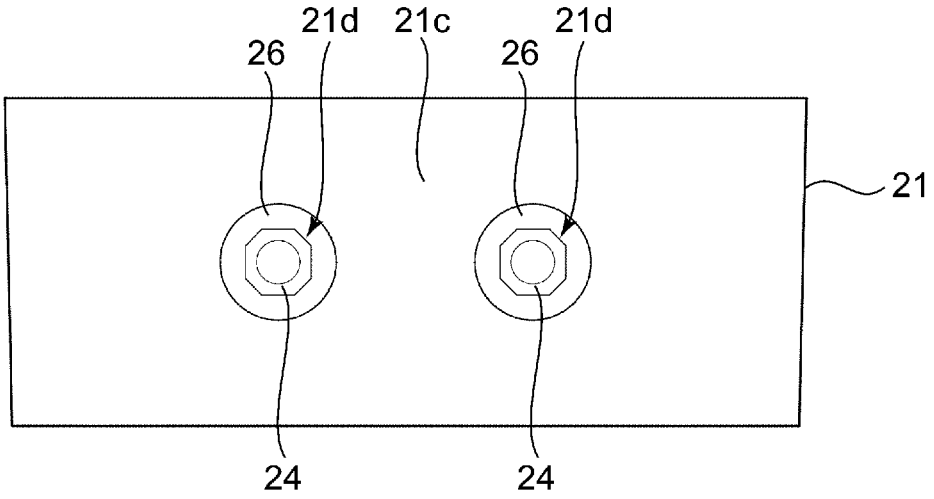
FIG. 7 is a plane view of the joining member of FIG. 5.
Figure 8:
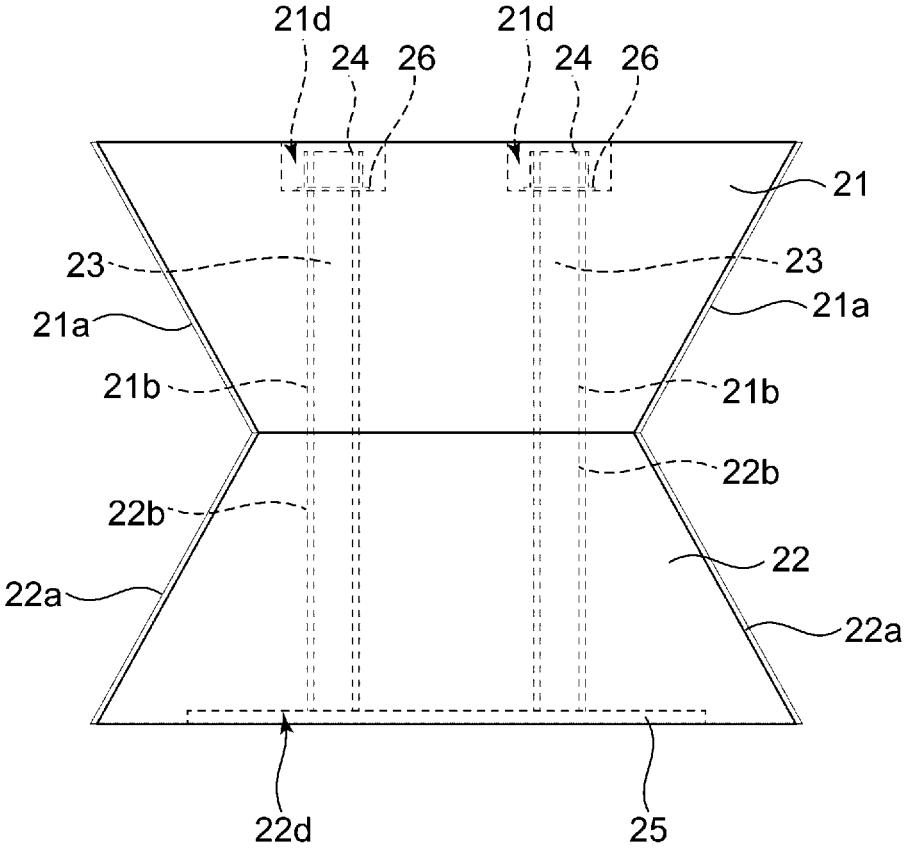
FIG. 8 is a front view of the joining member of FIG. 5.
Figure 9:
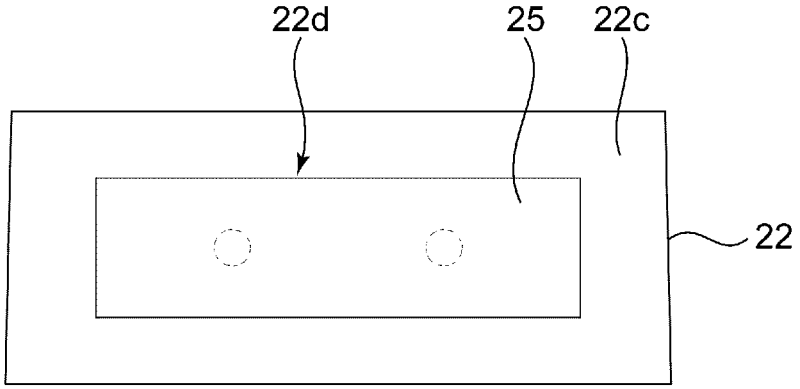
FIG. 9 is a bottom view of the joining member of FIG. 5.

FIG. 1 is a perspective view of a box-shaped building unit in an embodiment of the present invention, FIG. 2 is a front view of the box-shaped building unit of FIG. 1, FIG. 3 is a left side view of FIG. 2, FIG. 4 is an exploded perspective view of the joining part of a CLT panel, which enlarges the IV part of FIG. 1, FIG. 5 is a perspective view of a joining member, FIG. 6 is an exploded perspective view of the joining member of FIG. 5, and FIG. 7, FIG. 8, and FIG. 9 are a plane view, a front view, and a bottom view of the joining member of FIG. 5, respectively.

As illustrated in FIG. 1 to FIG. 3, the box-shaped building unit 1 in an embodiment of the present invention is formed by arranging CLT panels 10, 11, 12, 13, 14, 15, 16, 17, . . . on each surface of a rectangular parallelepiped (a ceiling surface, a bottom surface, and four side wall surfaces) and joining the adjacent CLT panels 10, 11, 12, 13, 14, 15, 16, 17, . . . by using a joining member 2 described below.

An orthogonal part of each surface of this rectangular parallelepiped (box-shaped building unit 1) has a structure wherein a surface of end of lumber or a surface of edge of lumber of one (second) CLT panel is made abut on an inner main surface of the other (first) CLT panel and joined thereto so that a surface of end of lumber or a surface of edge of lumber of the first CLT panel and an outer main surface of the second CLT panel are flush. Note that the surface of end of lumber of a CLT panel refers to the end surface in the longitudinal direction of the CLT panel, while the surface of edge of lumber of the CLT panel refers to the end surface in the lateral direction of the CLT panel.

For example, at the orthogonal part of the CLT panel 10 on the ceiling surface of the box-shaped building unit 1 and the CLT panel 11 on a side wall surface, a surface of edge of lumber 11*s* of the CLT panel 11 is made abut on an inner main surface 10*i* of the CLT panel 10 and joined thereto by the joining member 2 so that a surface of edge of lumber 10*s* of the CLT panel 10 and an outer main surface 11*o* of the CLT panel 11 are flush. The same applies to the orthogonal part of the CLT panel 10 on the ceiling surface and the CLT panel 15 on a side wall surface, the orthogonal part of the CLT panel 13 on a side wall surface and the CLT panel 14 on a side wall surface, and the orthogonal part of a CLT panel 16 on a side wall surface and the CLT panel 17 on a side wall surface. Further, the same applies to the orthogonal part of the CLT panels on the rear side that are not visible in FIG. 1.

At a joining part by the joining member 2, the surface of end of lumber or the surface of edge of lumber and the outer main surface of one (first) CLT panel are opened so that the outer main surface side is wider than the inner main surface side of the first CLT panel, and the surface of end of lumber or the surface of edge of lumber and at least the outer main surface of the other (second) CLT panel are opened so that the inner side of the second CLT panel is wider than the surface of end of lumber or surface of edge of lumber side of the second CLT panel.

For example, as illustrated in FIG. 4, an opening part 10*n* in which the surface of edge of lumber 10*s* and the inner main surface 10*i* and outer main surface 10*o* are opened is formed on the CLT panel 10, while an opening part 11*n* in which the surface of edge of lumber 11*s* and the inner main surface 11*i* and outer main surface 11*o* are opened is formed on the CLT panel 11 at the joining part of the CLT panel 10 and the CLT panel 11. The opening part 10*n* is formed so that it has an inverted isosceles trapezoid-shape wherein the top base is longer than the bottom base as viewed from the surface of edge of lumber 10*s*, in other words, so that the outer main surface 10*o* side is wider than the inner main surface 10*i* side of the CLT panel 10. The opening part 11*n* is symmetrical to the opening part 10*n* and is formed so that it has an isosceles trapezoid-shape wherein the top base is shorter than the bottom base as viewed from the outer main surface 11*o*, in other words, so that the inner side (the side away from the surface of edge of lumber 11*s* (lower side of FIG. 4)) is wider than the surface of edge of lumber 11*s* side of the CLT panel 11. The same applies to the joining parts at the orthogonal parts of other CLT panels.

The joining member 2 is a butterfly joint-shaped joining member having a shape corresponding to the above-described opening parts 10*n* and 11*n*. As illustrated in FIG. 5 to FIG. 9, the joining member 2 consists of a first member 21 having a shape corresponding to the opening part 10*n* of the CLT panel 10 and a second member 22 having a shape corresponding to the opening part 11*n* of the CLT panel 11. The first member 21 and the second member 22 are coupled by a bolt 23 and a nut 24. Two bolts 23 are fixed on a plate 25.

The first member 21 and the second member 22 are formed of CLTs. The first member 21 and the second member 22 have a shape corresponding to the opening parts 10*n* and 11*n*, respectively, provided that a leg part 21*a* of the isosceles trapezoid-shape of the first member 21 and a leg part 22*a* of the trapezoid-shape of the second member 22 are inclined so that force to tighten the CLT panels 10 and 11 is applied when the joining member 2 is inserted into the opening parts 10*n* and 11*n* from the outer side of the box-shaped building unit 1 (the surface of end of lumber or surface of edge of lumber of the first CLT panel and the outer main surface of the second CLT panel side), in other words, when the joining member is inserted from the surface of edge of lumber 10*s* of the CLT panel 10 and the outer main surface 11*o* of the CLT panel 11 side in the example of FIG. 4.

Further, holes 21*b* and 22*b* through which the bolt 23 passes are formed on the first member 21 and the second member 22, respectively. A counterbore 21*d* is formed on a bottom part 21*c* of the isosceles trapezoid-shape of the first member 21 so that the nuts 24 and washers 26 do not protrude. A counterbore 22*d* is formed on a bottom part 22*c* of the isosceles trapezoid-shape of the second member 22 so that the plate 25 does not protrude. The joining member 2 is a member resulting from fitting the first member 21 and the second member 22 with the above-described configuration onto the bolts 23 on the plate 25 in such a manner that the bolts pass through those members, and coupling those members by tightening them with the nuts 24 via the washers 26.

With the box-shaped building unit 1 having the above-described configuration, it is possible to readily join the adjacent CLT panels 10, 11, 12, 13, 14, 15, 16, 17 . . . by arranging the CLT panels 10, 11, 12, 13, 14, 15, 16, 17 . . . on each surface of a rectangular parallelepiped (a ceiling surface, a bottom surface, and four side wall surfaces), and inserting the butterfly joint-shaped joining member 2 into the opening parts 10*n*, 11*n* and the like that are outwardly opened.

In particular, with this box-shaped building unit 1, it is possible to tighten the bolts 23/nuts 24 from the outer main surface 10*o* side of the CLT panel 10 to tighten the first member 21 and the second member 22 of the joining member 2 when the CLT panel 10 and the CLT panel 11 or the like are loosely tightened, thereby firmly tightening the CLT panel 10 and the CLT panel 11 or the like. Furthermore, it is also possible to form the first member 21 and the second member 22 of elastic members such as rubber, thereby causing the box-shaped building unit 1 to have a base isolation structure.

Further, in the box-shaped building unit 1 in the present embodiment, an opening is similarly provided to the adjacent CLT panel 11 and CLT panels 12 and 13 on each surface of the rectangular parallelepiped, and those panels are joined by using a joining member 2. The same applies to joining of the CLT panel 15 and the CLT panels 14 and 16.

Figure 10:
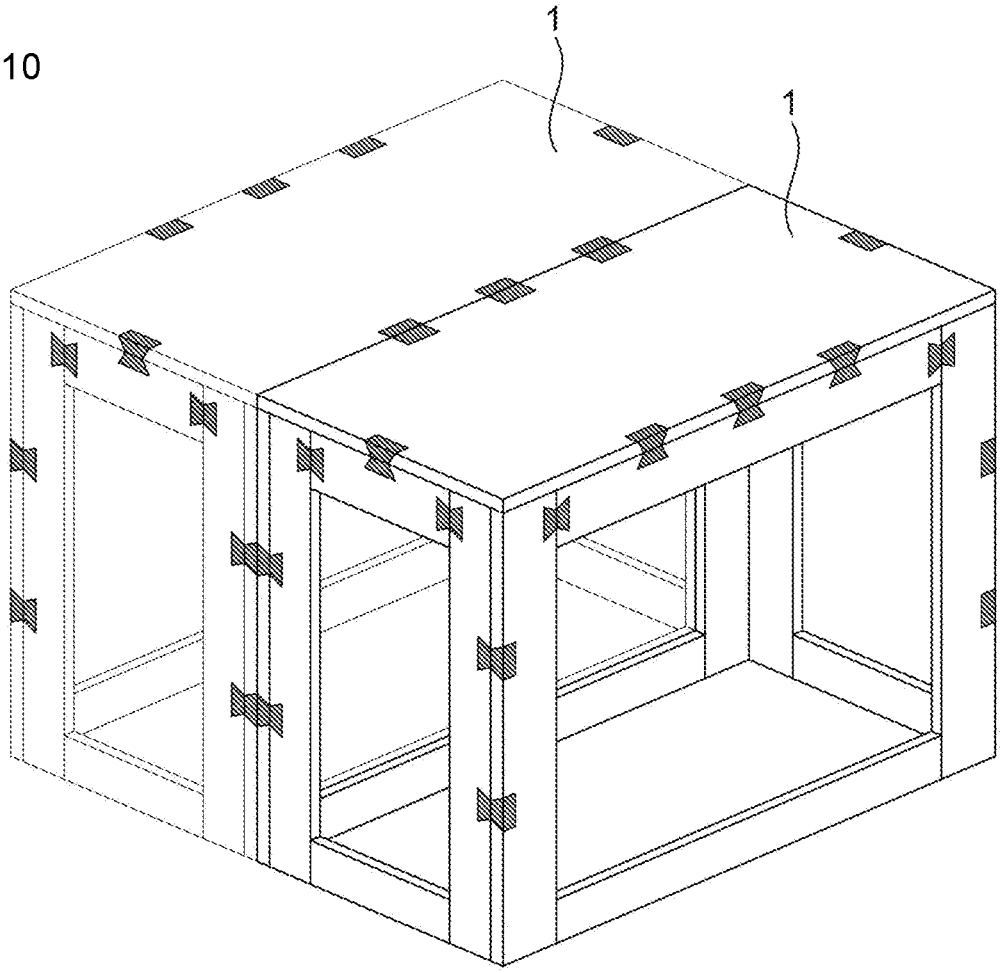
FIG. 10 is a perspective view of a building using the box-shaped building unit of FIG. 1.

In addition, it is also possible to configure a building by coupling a plurality of the above-described box-shaped building units 1 as illustrated in FIG. 10.

INDUSTRIAL APPLICABILITY

The present invention is useful as a box-shaped building unit in which CLT panels are joined and a building using said unit.

REFERENCE SIGNS LIST

1 box-shaped building unit
2 joining member
10, 11, 12, 13, 14, 15, 16, 17 CLT panel
21 first member
22 second member

The invention claimed is:

1. A box-shaped building unit comprising:

a ceiling surface CLT panel, a first side wall CLT panel, a second side wall CLT panel, a third side wall CLT panel, and a fourth side wall CLT panel that correspond to first to fourth side wall surfaces of the box-shaped building unit, respectively; and a plurality of orthogonal panel joining structures, each orthogonal panel joining structure being respectively implemented by:

one of the ceiling surface CLT panel, the first side wall CLT panel, the second side wall CLT panel, the third side wall CLT panel, and the fourth side wall CLT panel as a first CLT panel, another of the ceiling surface CLT panel, the first side wall CLT panel, the second side wall CLT panel, the third side wall CLT panel, and the fourth side wall CLT panel as a second CLT panel orthogonal to the first CLT panel, and a joining member, the orthogonal joining structure having a structure wherein a first end surface in the longitudinal direction of the second CLT panel or a second end surface in the lateral direction of the second CLT panel abuts an inner main surface of the first CLT panel and joined thereto by the joining member so that a third end surface in the longitudinal direction of the first CLT panel or a fourth end surface in the lateral direction of the first CLT panel and an outer main surface of the second CLT panel are flush, wherein the third end surface or the fourth end surface and the inner main surface and an outer main surface of the first CLT panel contain an opening having a configuration that is wider at the outer main surface side of the first CLT panel than at the inner main surface side of the first CLT panel, wherein the first end surface or the second end surface and at least the outer main surface of the second CLT panel contain an opening having a configuration that is wider at a position distal the first end surface of the second CLT panel than at the first end surface, and wherein the joining member is configured to be inserted into the opening of the first CLT panel and the opening of the second CLT panel from the third end surface or the fourth end surface and the outer main surface of the second CLT panel side, wherein the the first side wall CLT panel, the second side wall CLT panel, the third side wall CLT panel, and the fourth side wall CLT panel correspond to first to fourth side wall surfaces of the box-shaped building unit, respectively, wherein the first side wall CLT panel is joined with the second side wall CLT panel by one or more of the plurality of orthogonal panel joining structures, wherein the first side wall CLT panel is joined with the fourth side wall CLT panel by one or more of the plurality of orthogonal panel joining structures, wherein the third side wall CLT panel is joined with the second side wall CLT panel by one or more of the plurality of orthogonal panel joining structures, wherein the third side wall CLT panel is joined with the fourth side wall CLT panel by one or more of the plurality of orthogonal panel joining structures, wherein the ceiling surface CLT panel and each of the first side wall CLT panel, the second side wall CLT panel, the third side wall CLT panel, and the fourth side wall CLT panel are joined by one or more of the plurality of orthogonal panel joining structures, wherein the first side wall CLT panel comprises a first left section and a right section that join the ceiling surface CLT panel and a bottom surface of the box-shaped building unit, wherein the second side wall CLT panel comprises a second left section and a second right section that join the ceiling surface CLT panel and the bottom surface of the box-shaped building unit, wherein the third side wall CLT panel comprises a third left section and a third right section that join the ceiling surface CLT panel and the bottom surface of the box-shaped building unit, wherein the fourth side wall CLT panel comprises a fourth left section and a fourth right section that join the ceiling surface CLT panel and the bottom surface of the box-shaped building unit, wherein the first right section and the fourth left section are joined by one or more of the plurality of orthogonal panel joining structures, wherein the second right section and the first left section are joined by one or more of the plurality of orthogonal panel joining structures, wherein the third right section and the second left section are joined by one or more of the plurality of orthogonal panel joining structures, wherein the fourth right section and the third left section are joined by one or more of the plurality of orthogonal panel joining structures.

2. The box-shaped building unit of claim 1, being a building for a housing structure.

3. The box-shaped building unit of claim 1, wherein the opening of the second CLT panel is an opening in which the first end surface or the second end surface and the inner main surface and outer main surface of the second CLT panel comprise the opening.

4. The box-shaped building unit of claim 1, wherein the joining member is butterfly joint-shaped.

* * * * *